US006741021B2

(12) United States Patent
Amano et al.

(10) Patent No.: US 6,741,021 B2
(45) Date of Patent: May 25, 2004

(54) ELECTRON GUN AND PRODUCTION METHOD THEREOF

(75) Inventors: Yasunobu Amano, Toyko (JP); Masahiko Mizuki, Kanagawa (JP); Koichi Tahara, Nara (JP); Noritaka Hamaya, Mie (JP); Masamichi Senami, Mie (JP)

(73) Assignee: Sony Corporation (JP)

( * ) Notice: Subject to any disclaimer, the term of this patent is extended or adjusted under 35 U.S.C. 154(b) by 435 days.

(21) Appl. No.: 09/745,409

(22) Filed: Dec. 26, 2000

(65) Prior Publication Data

US 2001/0013752 A1 Aug. 16, 2001

(30) Foreign Application Priority Data

Dec. 27, 1999 (JP) ..... P11-369203

(51) Int. Cl.[7] ..... H01J 29/50; H01J 29/46
(52) U.S. Cl. ..... 313/417; 313/421; 313/446
(58) Field of Search ..... 313/417–421, 313/426, 446

(56) References Cited

U.S. PATENT DOCUMENTS 3,156,029 A * 11/1964 Simon ..... 445/35
5,280,215 A * 1/1994 Ohtake et al. ..... 313/403
5,411,822 A * 5/1995 Ohtake et al. ..... 430/5
6,225,766 B1 * 5/2001 Ono et al. ..... 315/382
6,570,349 B2 * 5/2003 Kimiya et al. ..... 315/382

FOREIGN PATENT DOCUMENTS

JP 0143638 * 5/2001

* cited by examiner

*Primary Examiner*—Jay Patidar
(74) *Attorney, Agent, or Firm*—Rader, Fishman & Grauer PLLC; Ronald P. Kananen

(57) ABSTRACT

An electron gun includes a grid electrode having a thin plate portion in which an electron beam aperture is formed, wherein the thin plate portion is formed by using a die and punch die to bulge a portion of a metal plate in the plate thickness direction to such an extent as to correspond to the desired dimension of the thin plate portion to form a bulged portion and cutting the bulged portion. With this configuration, it is possible to eliminate a problem of the related art thin plate portion of a grid electrode for an electron gun formed by coining work, which is a rib is formed around the thin plate portion, to make the gap between the thin plate portion and a cathode narrower, since the diameter of the thin plate portion can be enlarged, and to provide beam apertures at arbitrary positions of the thin plate portion.

20 Claims, 4 Drawing Sheets

ELECTRON GUN AND PRODUCTION METHOD THEREOF

BACKGROUND OF THE INVENTION

The present invention relates to an electron gun for a cathode ray tube and a method of producing the electron gun.

Cathode ray tubes for television receivers and computer displays have been recently required to display an image with higher definition.

Along with this requirement, there is a trend toward the reduction in diameter of the electron beam aperture (hereinafter, referred to as "beam aperture") of each grid electrode of the electron gun used for cathode ray tubes.

For an electron gun used for displays, the diameter of the beam aperture of the first grid electrode closest to the cathode of the electron gun has been shifted yearly, for example, from ϕ0.43 mm to about ϕ0.32 mm, and further to about ϕ0.30 mm.

To drive such an electron gun in which the diameter of the beam aperture is reduced at the same voltage as a conventional voltage, it is required to reduce the gap between the cathode and the first grid electrode.

To realize a reduction in gap between the cathode and first grid electrode, it is required to make the thickness of the metal plate constituting the first grid electrode thin.

In actuality, along with the above-described shift of the diameter of the beam aperture, the thickness of a portion, of the first grid electrode around the beam aperture has been made gradually thin, for example, from 0.06 mm to 0.05 mm, and further, to 0.045 mm.

The step of making a portion of a metal plate thin as a material for the grid electrode of an electron gun is one of the essential sequential steps of producing the electron gun.

In general, there may be considered a method of making a portion of a metal plate thin by cutting it with a drill.

Such a method, however, has the problem that as the desired thickness of the thin plate portion to be formed at part of the metal plate becomes smaller, the relatively thinned plate portion of the metal plate may be cut off by the cutting resistance applied thereto by drilling.

For this reason, the portion of a metal plate used as a material for a grid electrode has been made thin by coining work.

Coining work is the method of making portion of a metal plate thin by coining (striking) it.

FIG. 1 is a conceptual view illustrating the coining work for a metal plate.

First, a prepared hole 51 having a diameter of ϕD1 is formed in a metal plate 50 as a material for a grid electrode.

A portion of the metal plate 50 around the prepared hole 51 is coined, to form the thin plate portion 52.

At this time, the coined-wall portion of the metal plate 50 runs off inwardly and outwardly.

After the coining work, a remaining hole 53 having a diameter of ϕD2 is thus formed by the inward run-off of the coined-wall portion.

A bulged portion 54 is also formed around the thin plate portion 52 by the outward run-off of the coined-wall portion.

FIG. 2 is a sectional view showing an essential portion of a related art first grid electrode produced by the coining work.

The essential portion of the first grid electrode G1 shown in FIG. 2, which is located around the beam aperture 60, is made gradually thin by subjecting a portion of the metal plate 61 to the coining work, which is repeated multiple times.

To make the thickness of a portion of the metal plate 61 around the beam aperture 60 as thin as material of the first grid electrode G1 from an original thickness T0 to a desired thickness t0, it is required to make the thickness of a portion outside the above portion around the beam aperture 60, into a thickness t0 ' by the coining work.

To repeat the coining work multiple times, the coined wall portion of the metal plate 61 must run off inwardly and outwardly for each coining work.

Accordingly, after completion of the repeated coining works, circular ribs 63 and 64 are formed around a thin plate portion 62 having the desired thickness t0.

As described above, according to the related art method, since it is required to repeat the coining work multiple times for making a portion, of a metal plate around the beam aperture thin, the circular ribs 63 and 64 are formed around the thin plate portion 62.

The presence of the circular ribs 63 and 64 around the thin plate portion 62 correspondingly requires an excess space to accommodate the ribs 63 and 64 around the thin plate portion 62.

On the other hand, for an inline type electron gun, three cathodes corresponding to three colors, red (R), green (G), and blue (B) must be provided in an inline array.

The arrangement pitch of the cathodes must be set in a specific range, typically, from 4.5 mm to 6.6 mm.

As a result, if it is required to ensure an excess space to accommodate the circular ribs 63 and 64 around the thin plate portion 62, it becomes difficult to set the arrangement pitch of the cathodes within the specific range.

To reduce the distance between the cathode and the first grid electrode, it is effective to enlarge the worked area S of the thin plate portion 62 and to set an end portion of the cathode on the worked area S.

In the case of enlarging the worked area S of the thin plate portion 62, however, the diameters of the above-described circular ribs 63 and 64 are correspondingly enlarged, with the result that the arrangement pitch of the cathodes cannot be set in the specific range.

Since the outer portion of the thin plate portion 62 is made thin into the thickness t0 ', it is difficult to ensure the part strength of the grid electrode required for assembly of the electron gun.

Further, as shown in FIG. 1, for subjecting the metal plate 50 to coining work, the prepared hole 51 must be provided previously in the metal plate 50.

The formation of the prepared hole 51 causes the following problem: namely, even if the diameter of the prepared hole 51 is strictly controlled, variations in the diameter and the position of the remaining hole 53 produced by the coining work occur depending on the non-controllable degree of run-off of the coined wall portion.

Accordingly, after the coining work, a beam aperture having a specific diameter must be formed in such a manner as to satisfy the condition of permitting variations in diameter and position of the remaining hole 53; that is, a condition capable of perfectly removing the remaining hole 53.

Further, as the beam aperture becomes smaller, the occupied rate of the remaining hole 53 to the beam aperture becomes larger and, therefore, in the worst case, the remaining hole 53 may remain partly upon formation of the beam aperture.

SUMMARY OF THE INVENTION

An object of the present invention is to provide an electron gun, including a grid electrode formed without any circular rib and any remaining hole by, coining and a method of producing the electron gun.

To achieve the above object, according to a first aspect of the present invention, there is provided an electron gun including a grid electrode having a thin plate portion in which an electron beam aperture is formed, wherein said thin plate portion is formed by bulging a portion of a metal plate in the plate thickness direction to such an extent as to correspond to the desired dimension of said thin plate portion, forming the bulged portion, and cutting said bulged portion.

With this configuration, it is possible to form a thin plate portion having a high dimensional accuracy without any remaining hole due to the formation of a prepared hole and any circular rib.

According to a second aspect of the present invention, there is provided a method of producing an electron gun having a thin plate portion, including the steps of bulging a portion of a metal plate as a material for a grid electrode in the plate thickness direction to such an extent as to correspond to the desired thickness of the thin plate portion, forming the bulged portion, and cutting the bulged portion, preferably, to a depth lower than the surface of the metal plate, and thereby forming the thin plate portion at part of the metal plate.

With this configuration, it is possible to form a thin plate portion having a high dimensional accuracy without any remaining hole due to the formation of a prepared hole and any circular rib.

As a result, an electron beam aperture having a desired diameter can be formed at an arbitrary position of the thin plate portion.

Further, since the thickness of a portion, of the metal plate around the thin plate portion can be kept as the original thickness of the metal plate, the worked area of the thin plate portion can be enlarged without the lack of mechanical strength required for a grid electrode for an electron gun.

BRIEF DESCRIPTION OF THE DRAWINGS

FIGS. 4A to 4C are sectional views illustrating a method of producing a grid electrode for an electron gun by working a metal plate, wherein FIG. 4A shows the step of setting a metal plate between a die having an opening type run-off portion and a punch die, FIG. 4B shows the step of forming a bulged portion by using the punch die, and FIG. 4C shows the step of removing the bulged portion by a cutting tool;

FIGS. 5A and 5B are sectional views illustrating another method of producing a grid electrode for an electron gun by working a metal plate, wherein FIG. 5A shows the step of setting a metal plate between a die having a recess type run-off portion and a punch die, and FIG. 5B shows the step of perfectly removing a bulged portion;

DETAILED DESCRIPTION OF PREFERRED EMBODIMENT

Hereinafter, the preferred embodiment of the present invention will be described with reference to the drawings.

Figure 3:
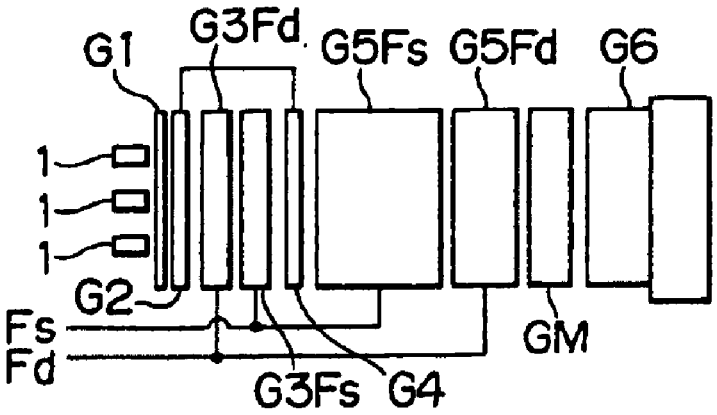
FIG. 3 is a schematic plan view showing the structure of an electron gun of the present invention.

FIG. 3 is a schematic plan view showing the structure of an electron gun constructed in accordance with the embodiment of the present invention.

Referring to FIG. 3, three cathodes 1 adapted to emit electron beams for displaying red, green, and blue are built in an inline array.

A plurality of grid electrodes for controlling the electron beams are arranged in series on the electron beam emission side of the electron gun.

To be more specific, a first grid electrode GI, a second grid electrode G2, a third grid electrode G3Fd to which a dynamic voltage is applied, a third grid electrode G3Fs to which a static voltage is applied, a fourth electrode G4, a fifth grid electrode G5Fs to which a static voltage is applied, a fifth grid electrode G5Fd to which a dynamic voltage is applied, an intermediate grid electrode GM, and a sixth grid electrode G6 are disposed in this order from left to right, that is, from the cathode side to the beam emission side in FIG. 3.

Along with the trend to reduce the spot diameter of each electron beam, the gaps between two adjacent grid electrodes, particularly, the gap between the first grid electrode G1 and the second grid electrode G2, are required to be reduced by making the thickness of a portion of each of the adjacent two around a beam aperture thin.

A method of producing a grid electrode, having a beam aperture, of an electron gun, particularly, the first grid electrode G1 or the second grid electrode G2 according to the present invention, will be described below.

Figure 4A:
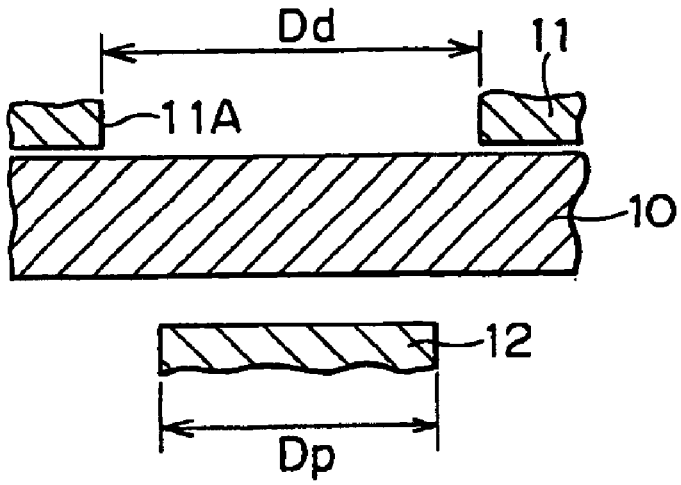
Figure 4B:
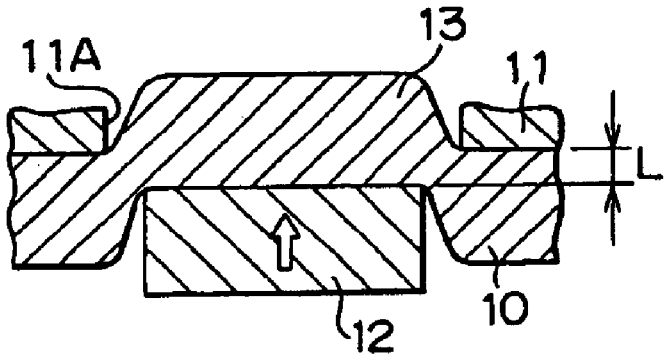
Figure 4C:
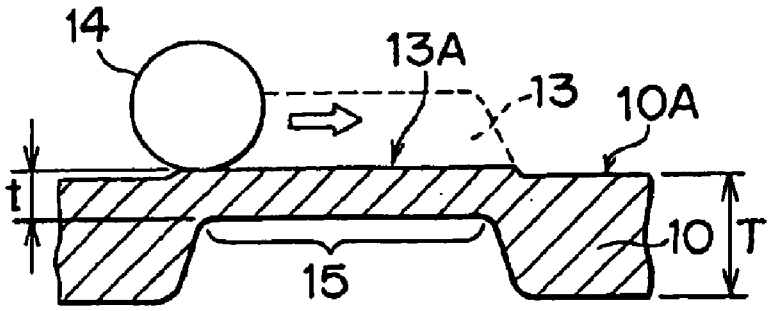

FIGS. 4A to 4C are views illustrating the steps of working a metal plate as a material for a grid electrode of an electron gun.

First, as shown in FIG. 4A, a metal plate 10 as a material for a grid electrode of an electron gun, typically, the first grid electrode G1, is prepared.

The metal plate 10 may be made from Kovar (an alloy containing 53 wt % of Fe, 28 wt % of Ni, and 18 wt % of Co) or a stainless steel (SUS material specified in JIS).

The metal plate 10 is set between a die 11 and a punch die 12.

The die 11 has a run-off portion 11A for allowing a portion of the metal plate 10 to be bulged therein (which will be described later) when the metal plate 10 is pressed between the die 11 and the punch die 12.

To allow easy bulging of a portion of the metal plate 10 and to prevent a shearing force from being applied between the die 11 and the punch die 12 when the metal plate 10 is pressed between the die 11 and the punch die 12, the outside diameter Dp of the punch die 12 is set to be smaller than an inside diameter Dd of the die 11 (Dp<Dd).

Subsequently, as shown in FIG. 4B, the punch die 12 is moved in the direction shown by an arrow, that is, upwardly, while the motion of the metal plate 10 is restricted by the die 11.

With this bulging work, a portion 13 of the metal plate 10 is bulged along the thickness direction (upwardly in FIG. 4B) in the run-off portion 11A of the die 11. The bulged amount of the metal plate 10 is determined depending on the desired thickness of a thin plate portion to be finally formed at part of the metal plate 10.

The principle of such bulging work is the same as that of the usual drawing work.

That is to say, like the usual drawing work, the bulging work is performed by bulging a portion of the metal plate 10 in one direction to form the bulged portion 13.

In this embodiment, as shown in FIG. 4B, the terminal end of upward movement of the punch die 12 is set at a position lower than the contact surface of the metal plate 10 with the die 11 by a specific dimension L. The specific dimension L is determined depending on the above-described desired thickness of the thin plate portion to be formed at part of the metal plate 10.

To finish the thin plate portion formed at part of the metal plate 10 (to be described later), however, the punch die 12 may be moved upwardly to a position higher than the above-described position.

It should be noted that the bulging work may be performed by moving the die 11 in the direction opposite to the direction shown by the arrow, that is, downwardly in FIG. 4B, while the motion of the metal plate 10 is restricted by the punch die 12.

As shown in FIG. 4C, the bulged portion 13 is cut by moving a cutting tool 14 in the direction perpendicular to the thickness direction of the metal plate 10, that is, in the direction shown by the arrow in the figure.

To be more specific, the bulged portion 13 is cut until the cut plane 13A of the bulged portion 13 becomes substantially the same level as that of the non-worked plane 10A of the metal plate 10, that is, until the bulged portion 13 is almost removed, and whereby a thin plate portion 15 having a desired thickness "t" is formed at part of the metal plate 10.

During this cutting work, the plane of the thin plate portion 15, which is opposed to the cut plane 13A, may be supported by a base (not shown).

The bulged portion 13 may be cut by moving the cutting tool 14 by one time or several times.

The cutting work may be performed by using a milling cutter, such as a plain milling cutter or face milling cutter.

After that, while not shown, a beam aperture is formed in the thin plate portion 15 by punching work using a micro-punch die.

As described above, either the bulging work or the cutting work can be performed without the need of for providing any prepared hole in the metal plate 10.

Unlike the related art method, there is no remaining hole in the thin plate portion 15 of the metal plate 10.

Accordingly, it is not required to form the beam aperture such that the beam aperture entirely contains the remaining hole.

In other words, a beam aperture having a desired diameter can be formed at an arbitrary position of the thin plate portion 15.

According to this embodiment, therefore, a beam aperture having a diameter smaller than that of a beam aperture having been formed by the related art method can be provided at a central portion of the thin plate portion 15.

Further, according to the related art method, in the case of producing a grid electrode having a plurality of beam apertures for an electron gun, typically, two beam apertures for each cathode, one beam aperture has been required to be provided at a central portion, that is, at the remaining hole portion of the thin plate portion.

On the contrary, according to the present invention, since the thin plate portion has no remaining hole portion, beam apertures can be formed at a plurality of positions other than the central portion of the thin plate portion 15, for example, at symmetrical positions around the center of the thin plate portion 15.

Accordingly, it becomes apparent that the method of the present invention is particularly suitable for producing a plurality of beam apertures in the thin plate portion of a grid electrode for an electron gun.

In this way, a grid electrode for an electron gun, typically, the first grid electrode is provided.

A variation of the above-described embodiment will be described with reference to FIGS. 5A to 5C.

Figure 5A:
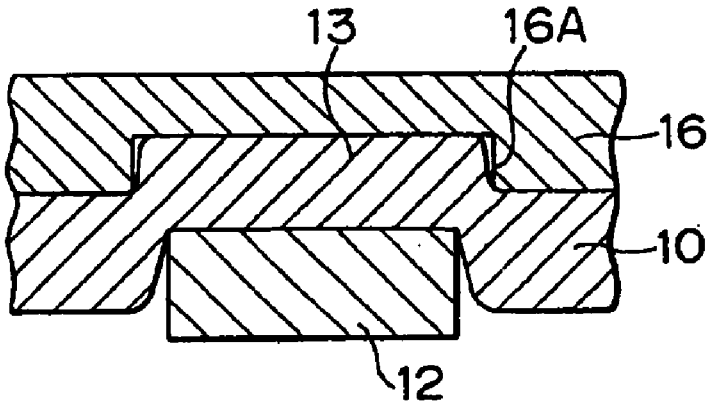

A metal plate 10 is set between a die 16 having a run-off portion 16A with a recessed shape in the cross section shown in FIG. 5A and a punch die 12. A portion 13 of the metal plate 10 is bulged by coining work using the die 16 and the punch die 12.

Figure 5B:
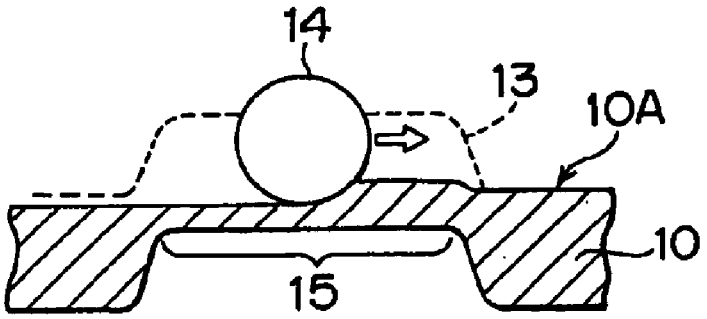

After the bulging work, cutting work may be performed, as shown in FIG. 5B, by cutting the bulged portion 13 to a depth lower than the non-worked plane 10A of the metal plate 10. With this cutting work, the bulged portion 13 can be perfectly removed.

The present inventors have conducted a production test for confirming the effect of the above-described variation.

A portion of the metal plate 10 having a thickness of 0.25 mm was bulged to a dimension of 0.19 mm.

The bulged portion 13 was cut to a depth lower than the non-worked plane 10A of the metal plate 10 by a dimension of 0.02 mm.

As a result, a thin plate portion 15 having a thickness of 0.04 mm was obtained.

Figure 5C:
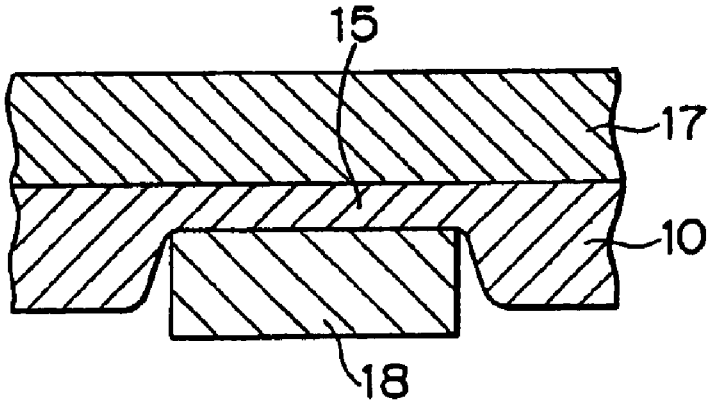
FIG. 5C is a sectional view illustrating a further method of producing a grid electrode for an electron gun by working a metal plate, wherein the thin plate portion is finished by coining using a punch die.

In addition, after the cutting work shown in FIG. 4C, the thin plate portion 15 of the metal plate 10 may be subjected to the coining work shown in FIG. 5C. That is to say, the thin plate portion 15 is held between an adjusting die 17 and an adjusting punch die 18, and followed by coining.

The coining work may be performed after the cutting work shown in FIG. 5B.

The coining of the thin plate portion 15 performed after the cutting work shown in FIG. 4C is effective to smooth both the cut plane 13A and the plane 10A of the metal plate 10.

The coining of the thin plate portion 15 performed after each of the cutting works shown in FIG. 4C and 5B is effective to make the thickness of the thin plate portion 15 thinner and to enhance the dimensional accuracy of the thin plate portion 15.

As described above, in the method of producing an electron gun according to the present invention, the thin plate portion 15 is formed by bulging a portion of the metal plate 10 as a material of a grid electrode in the plate thickness direction to such an extent as to correspond to the desired thickness of the thin plate portion 15, to form the bulged portion 13, and then cutting the bulged portion 13.

The production method of the present invention, therefore, has the following advantages:

Unlike the related art method, a circular rib is not formed around the thin plate portion 15.

Since the portion, around the thin plate portion 15 of the metal plate 10 is not made thin by coining unlike the related art method, the thickness T (See FIG. 4) of such a portion of the metal plate 10 can be kept as the original thickness of the metal plate 10.

This eliminates the need for the provision of an excess space to accommodate a rib around the thin plate portion 15.

As a result, it is possible to make the array interval of the three cathodes 1 provided in the inline array shown in FIG. 3 narrower.

Since the thickness of the portion closer to the outer periphery of the thin plate portion 15 is sufficiently large, it is possible to enhance significantly the part strength of the grid electrode for an electron gun.

Since the thickness of the portion outside the thin plate portion 15 is sufficiently large, it is possible to ensure the part strength of the grid electrode required for the assembly of an electron gun.

Figure 1:
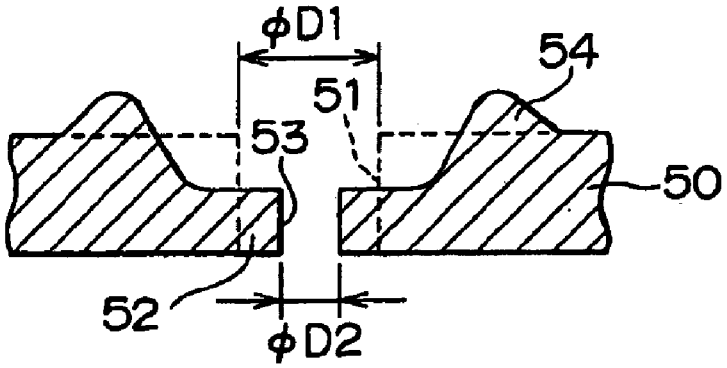
FIG.1 PRIOR ART
FIG. 1 is a sectional view of a metal plate wherein the metal plate before coining, which has a prepared hole, is shown by a broken line, and the metal plate after coining, which has a thin plate portion, a remaining hole, and a bulged portion, is shown by a solid line.
Figure 2:
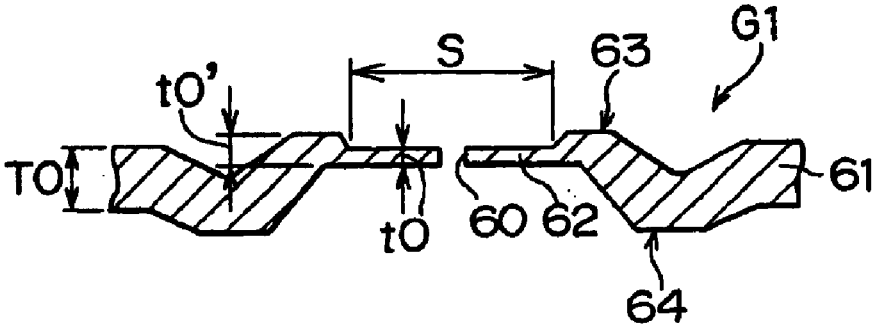
FIG.2 PRIOR ART
FIG. 2 is a sectional view of an essential portion of the related art grid electrode produced by coining, particularly showing a structure of the grid electrode around a beam aperture.
Figure 6A:
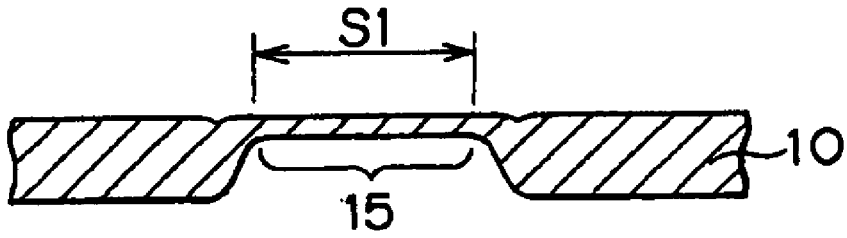
FIGS. 6A and 6B are sectional views each showing a thin plate portion of a grid electrode for an electron gun, produced by the production method of the present invention, wherein the diameter of the thin plate portion shown in FIG. 6A is nearly equal to that of a thin plate portion of a grid electrode produced according to the related art method, and the diameter of the thin plate portion shown in FIG. 6B is larger than that of the thin plate portion of the grid electrode produced according to the related art method.
Figure 6B:
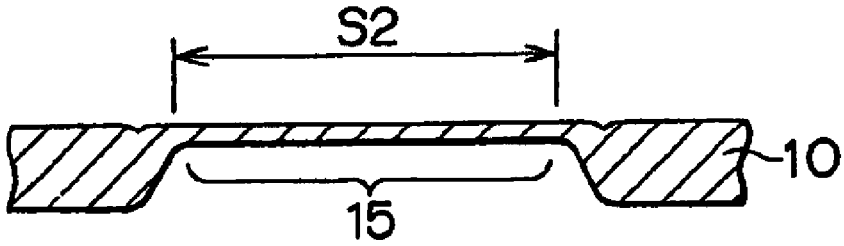

The absence of any rib around the thin plate portion 15 is further advantageous as follows: namely, as shown in FIGS. 6A and 6B, even if the area of the thin plate portion 15 is enlarged from a value S1, being the same as that of the related art thin plate portion shown in FIG. 2 to a value S2, the arrangement pitch of the cathodes can be set within a specific range.

This is because the absence of any rib around the thin plate portion 15 eliminates the need for the provision of excess space to accommodate the rib.

For example, the diameter of the recessed portion of the thin plate portion 15 can be made larger than the diameter of the end portion of the cathode.

In this case, the end portion of the cathode can be accommodated in the recessed portion of the thin plate portion 15.

As a result, the gap between the beam aperture of the first grid electrode G1 and the end portion of the cathode 1, that is, the electron emission portion can be made narrower than the gap between the beam aperture of the first grid electrode formed by the related art method and the end portion of the cathode 1.

This makes it possible to lower the drive voltage applied to an electron gun having a first grid electrode G1.

Further, as described above, any portion projecting in the thickness direction of the metal plate 10, typically, any rib, is not formed around the thin plate portion 15.

Accordingly, in the arrangement of a plurality of grid electrodes in series, as shown in FIG. 3, it is possible to make the distance between two adjacent of the grid electrodes narrow, particularly, to make the distance between the first grid electrode G1 and the second grid electrode G2 narrow.

As a result, the electron gun produced by the above-described production method can sufficiently meet the requirement for higher definition of the image displayed on a cathode ray tube or the like.

Since it is not required to take into account the run-off of a wall portion by coining, unlike the related art method, it is possible to enhance the degree of freedom in design.

Since the grid electrode formed by the above-described production method has a sufficiently high mechanical strength against deformation, the electron gun can be assembled without deformation of the grid electrode, even if pressure is applied thereto upon assembly of the electrode gun.

This makes it possible to enhance the assembling accuracy of the electron gun and, hence, to improve the beam-spot characteristic.

While the preferred embodiment of the present invention has been described using specific terms, such description is for illustrative purposes only, and it is to be understood that changes and variations may be made without departing from the spirit or scope of the following claims.

What is claimed is:

1. An electron gun comprising:

a grid electrode having a thin plate portion in which an electron beam aperture is formed, wherein said thin plate portion is formed by bulging a portion of a metal plate in the plate thickness direction to such an extent as to correspond to a desired dimension of said thin plate portion to form a bulged portion, and cutting said bulged portion.

2. An electron gun according to claim 1, wherein said thin plate portion is formed by cutting said bulged portion to a depth lower than the surface of said metal plate.

3. An electron gun according to claim 1 or 2, wherein said grid electrode having said thin plate portion is mounted in such a manner as to face toward a cathode.

4. An electron gun according to any one of claims 1 to 2, wherein a diameter of said thin plate portion of said grid electrode is larger than a diameter of an end portion of said cathode.

5. An electron gun according to any one of claims 1 to 2, wherein one, two or more electron beam apertures are provided at arbitrary positions of said thin plate portion.

6. An electron gun according to any one of claims 1 to 2, wherein one, two or more electron beam apertures are provided positions other than a central portion of said thin plate portion.

7. An electron gun according to any one of claims 1 or 2, wherein said thin plate portion is subjected to coining work after cutting said bulged portion.

8. An electron gun according to claim 7, wherein said grid electrode having said thin plate portion is mounted in such a manner as to face toward a cathode of said electron gun.

9. An electron gun according to claim 7, wherein a diameter of said thin plate portion of said grid electrode is larger than a diameter of an end portion of said cathode.

10. An electrode gun according to claim 7, wherein one, two or more electron beam apertures are provided at arbitrary positions of said thin plate portion.

11. A method of producing an electron gun according to claim 7, wherein one, two or more electron beam apertures are provided at positions other than a central portion of said thin plate portion.

12. A method of producing an electron gun having a thin plate portion, comprising the steps of:

bulging a portion of a metal plate as a material for a grid electrode in the plate thickness direction to such an extent as to correspond to a desired thickness of the thin plate portion, to form a bulged portion; and cutting the bulged portion, thereby forming the thin plate portion at part of the metal plate.

13. A method of producing an electron gun according to claim 12, wherein said cutting step comprises the step of cutting the bulged portion to a depth lower than the surface of the metal plate.

14. A method of producing an electron gun according to any one of claims 12 to 13, further comprising the step of forming an electron beam aperture in the thin plate portion after forming the thin plate portion at part of the metal portion.

15. A method of producing an electron gun according to any one of claims 12 to 13, further comprising the step of forming one, two or more electron beam apertures at arbitrary positions of the thin plate portion.

16. A method of producing an electron gun according to any one of claims 12 to 13, further comprising the step of forming one, or more electron beam apertures at positions other than a central portion of the thin plate portion.

17. A method of producing an electron gun according to claim 12 or 13, further comprising the step of subjecting the thin plate portion to coining work after forming the thin plate portion at part of the metal plate.

18. A method of producing an electron gun according to claim 17, further comprising the step of forming an electron beam aperture in the thin plate portion after forming the thin plate portion at part of the metal portion.

19. A method of producing an electron gun according to claim 17, further comprising the step of forming one, two or more electron beam apertures at arbitrary positions of the thin plate portion.

20. A method of producing an electron gun according to claim 17, further comprising the step of forming one, two or more electron beam apertures at positions other than a central portion of the thin plate portion.

* * * * *

UNITED STATES PATENT AND TRADEMARK OFFICE

CERTIFICATE OF CORRECTION

PATENT NO. : 6,741,021 B2
DATED : May 25, 2004
INVENTOR(S) : Yasunobu Amano et al.

It is certified that error appears in the above-identified patent and that said Letters Patent is hereby corrected as shown below:

Column 8,
Line 34, “cathode” should read -- cathode of said electron gun --.

Column 9,
Line 18, “one, or” should read -- one, two or --.

Signed and Sealed this

Fourth Day of January, 2005

JON W. DUDAS
*Director of the United States Patent and Trademark Office*